US006364289B1

(12) United States Patent
Cook

(10) Patent No.: US 6,364,289 B1
(45) Date of Patent: Apr. 2, 2002

(54) LOCKSMITH'S WEDGE FOR OPENING VEHICLE DOORS

(76) Inventor: David A. Cook, 5222 S. Cook Ct., Spokane, WA (US) 99223

( * ) Notice: Subject to any disclaimer, the term of this patent is extended or adjusted under 35 U.S.C. 154(b) by 0 days.

(21) Appl. No.: 09/551,501

(22) Filed: Apr. 17, 2000

(51) Int. Cl.[7] ..... B66F 3/00
(52) U.S. Cl. ..... 254/104
(58) Field of Search ..... 254/104; 144/193.1, 144/195.7

(56) References Cited

U.S. PATENT DOCUMENTS

| | | | | |
|---|---|---|---|---|
| 4,433,463 A | | 2/1984 | DuVal | |
| 4,688,761 A | | 8/1987 | Wilcox | |
| 4,789,134 A | | 12/1988 | Tenuto | |
| 4,830,320 A | * | 5/1989 | Bellows | 254/104 |
| 5,054,250 A | | 10/1991 | Foss | |
| 5,095,604 A | | 3/1992 | Baker | |
| 5,104,094 A | | 4/1992 | Womack | |
| 5,188,159 A | | 2/1993 | Lush | |

* cited by examiner

*Primary Examiner*—Robert C. Watson
(74) *Attorney, Agent, or Firm*—David S. Thompson

(57) ABSTRACT

A locksmith's wedge for opening vehicle doors includes a tapered lower body and a channelized upper body. The tapered lower body is sized to slide between the outer wiper and outer surface of a vehicle's window, thereby separating the wiper from the window so that a locksmith's unlocking tool may be inserted. The tapered lower body includes a tapered lower edge, a slightly ramped surface and a generally parabolic blade surface. A channelized upper body includes opposed sidewalls defining a channel between them. A parabolic inner surface extends the length of the wedge, on the side opposite the the sidewalls. A pair of tapered sides, adjacent to the parabolic inner surface, taper from a wide point adjacent to the top to a narrow point adjacent to the lower edge.

2 Claims, 4 Drawing Sheets

LOCKSMITH'S WEDGE FOR OPENING VEHICLE DOORS

CROSS-REFERENCES

There are no applications related to this application filed in this or any foreign country.

BACKGROUND

Unfortunately, it is common for the owner of an automobile to, at some time or another, lock the keys inside the car. And while locksmiths are able to open locked car doors, the ease with which the task can be performed depends not only on the skill of the locksmith, but also in large measure on the design of the tools available.

A first task in opening the door is to separate the wiper from the glass sufficiently for entry of a conventional locksmith's probing tool. The wiper is a rubber or rubber-like strip of material on either side of the car window at the top of the door. The wiper prevents water from entering the door while the window is rolled up, and as the window is rolled down, wipes water droplets from the surface of the glass. Unfortunately, while a tight fit between wiper and window is consistent with a weather-tight seal and with general security, it is inconsistent with the need of the locksmith to extend conventional probing tools into the car door.

As a result, tools have been developed to separate the wiper from the window, thereby allowing entry of tools designed to release the door lock. Such tools are generally known as wedges, having a tapered blade which separates the wiper from the window. As the wedge is further inserted, the thickness of the wedge further separates the wiper and window, allowing access for unlocking tools.

One such wedge tool is disclosed in U.S. Pat. No. 5,104,094, issued to Womack in 1992. Unfortunately, in many applications, the tapered end of such wedge tools have tended to slide along the surface of the glass window until contact is made with the frame surrounding the lower edge of the glass, and the wedge becomes stuck. Depending on the geometry of the wedge, window and frame, further insertion is typically not possible.

A related difficulty is that due to the general similarity of the shape of the window and the wedge, the wedge cannot be rocked or pivoted against the glass, thereby providing additional control over the separation of the wiper from the glass surface of the window.

A still further difficulty with prior art wedges is that they are solid in construction; i.e. they do not provide a slot or channel defined through the wedge through which the user may look to view the structures within the door of the car or support a flashlight to illuminate the door cavity.

For the foregoing reasons, there is a need for a locksmith's wedge for opening vehicle doors that can is easily inserted past the frame surrounding the lower edge of the glass pane of the vehicle's window, and that may be pivoted slightly against the glass surface of the vehicle's window in a manner that moves the wiper slightly, and that defines a channel through which the locksmith may view structures within the car's door or support a flashlight to illuminate the interior of the door cavity.

SUMMARY

The present invention is directed to an apparatus that satisfies the above needs. A novel locksmith's wedge for opening automobile doors is disclosed that can easily be inserted past the frame surrounding the lower edge of the glass pane of the car's window, and that may be pivoted slightly against the glass surface of the car's window in a manner that moves the wiper slightly, and that defines a channel through which the user may view structures within the car's door or support a flashlight to illuminate the door cavity.

The locksmith's wedge 10 for opening vehicle doors of the present invention provides some or all of the following structures.

(A) A tapered lower body 20, sized to slide between the outer wiper 101 and the outer surface of the vehicle's window 200, thereby separating the outer wiper from the vehicle's window to form a gap 105. A preferred tapered lower body includes:

- (a) A lower edge 21 formed by the intersection of two surfaces, resulting in a sufficiently sharp wedge- or chisel-type edge to easily separate the outer wiper from the window surface.
- (b) A slightly ramped surface 22 intersecting with the parabolic inner surface 80 form the lower edge 21.
- (c) A generally parabolic blade surface 23, adjacent to the slightly ramped surface 22, increases slightly in distance from the parabolic inner surface as the distance from the lower edge increases.

(B) A channelized upper body 40 is adjacent to a shoulder 42 defined on an upper portion of the generally parabolic blade surface 23. First and second sides of the channelized upper body support first and second opposed sidewalls 60, in a manner defining a channel through the upper body 40.

(C) First and second tapered side surfaces 90 extend the length of the locksmith's wedge, adjacent to first and second lengthwise sides of the generally parabolic blade surface. The first and second tapered side surfaces taper from a widest extent adjacent to the top 46 of the channelized upper body 40 to a narrowest extent adjacent to the lower edge 21.

(D) A parabolic inner surface 80, between the first and second tapered side surfaces, extends the length of the locksmith's wedge.

It is therefore a primary advantage of the present invention to provide a novel locksmith's wedge for opening vehicle doors having a taper precisely calculated to slide between wiper and window and a curved shape which allows superior control over the position of the wedge and the distance by which the wiper is separated from the window.

Another advantage of the present invention is to provide a locksmith's wedge for opening vehicle doors that is easily and inexpensively manufactured, and that is adaptable for use in a wide variety of cars and trucks.

A still further advantage of the present invention is to provide a locksmith's wedge for opening vehicle doors that includes an upper body having a channel defined in the upper body within which the locksmith may support a small flashlight to illuminate the vehicle's door's interior cavity.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

FIG. 1 is a view of a prior art locksmith's wedge, which has been inserted between the car window and the outer wiper of the car door. The tapered lower edge of the wedge has engaged the lower portion of the window frame. Depending on the geometry of the window, window frame and outer wiper, the wedge may be rendered completely useless for further insertion.

DESCRIPTION

Figure 1:
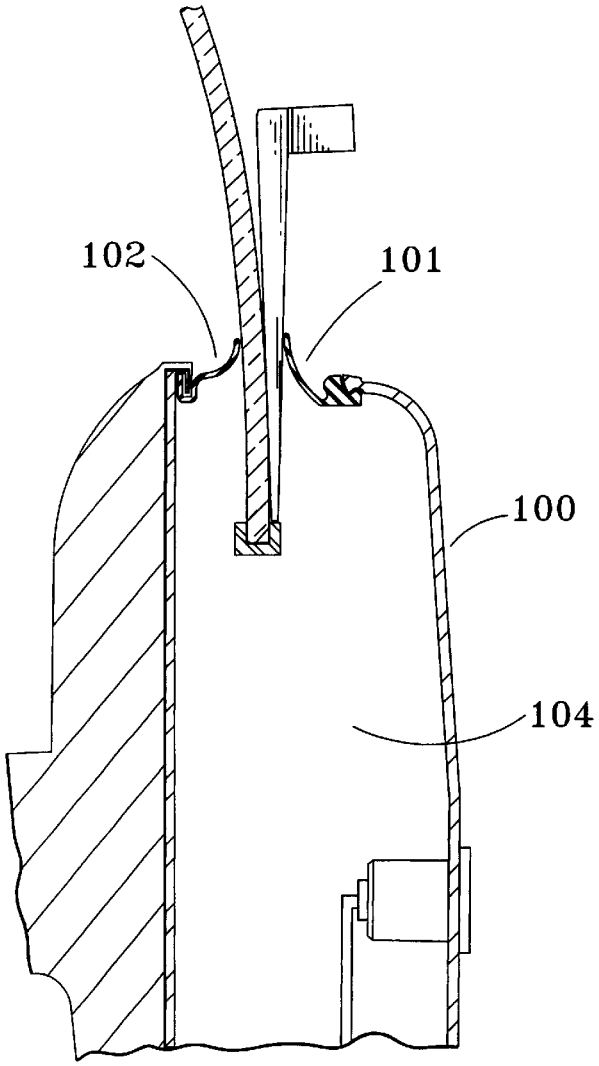
PRIOR ART FIG. 1

Referring in generally to FIGS. 2 through 6, a locksmith's wedge 10 for opening vehicle doors constructed in accordance with the principles of the invention is seen. A tapered lower body 20 is sized to slide between the outer wiper 101 and outer surface of a vehicle's window, thereby separating the wiper from the window so that a locksmith's unlocking tool may be inserted. The tapered lower body includes a tapered lower edge 21, a slightly ramped surface 22 and a generally parabolic blade surface 23. A channelized upper body 40 includes opposed sidewalls 60 defining a channel 41 between them. A parabolic inner surface 80 extends the length of the wedge, on the side opposite the the sidewalls 60. A pair of tapered sides 90, adjacent to the parabolic inner surface, taper from a wide point adjacent to the top 46 to a narrow point adjacent to the lower edge 21.

Figure 5:
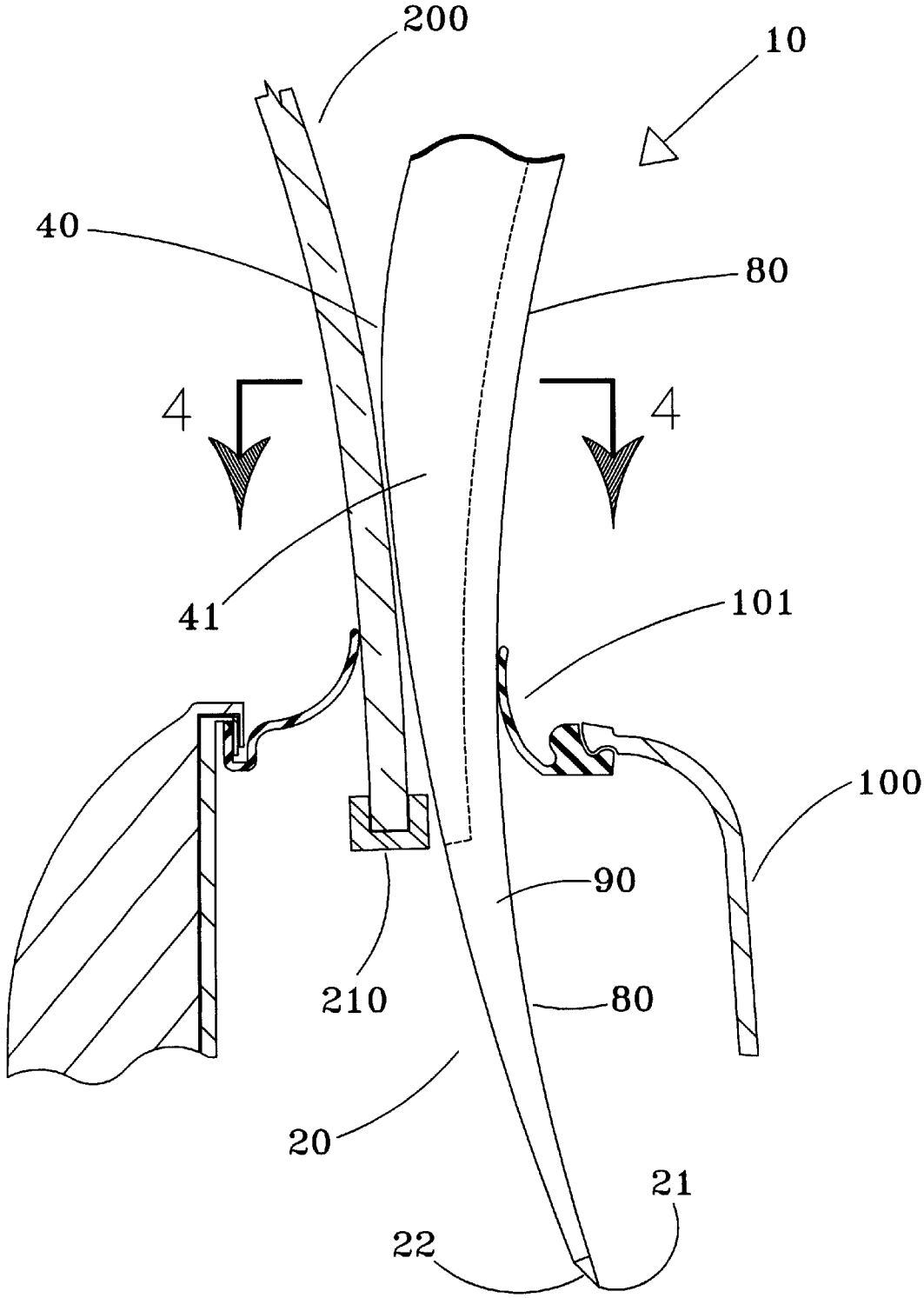
FIG. 5 is a side view of the wedge of FIG. 2, having been inserted between the outer wiper and window of a car's door.
Figure 6:
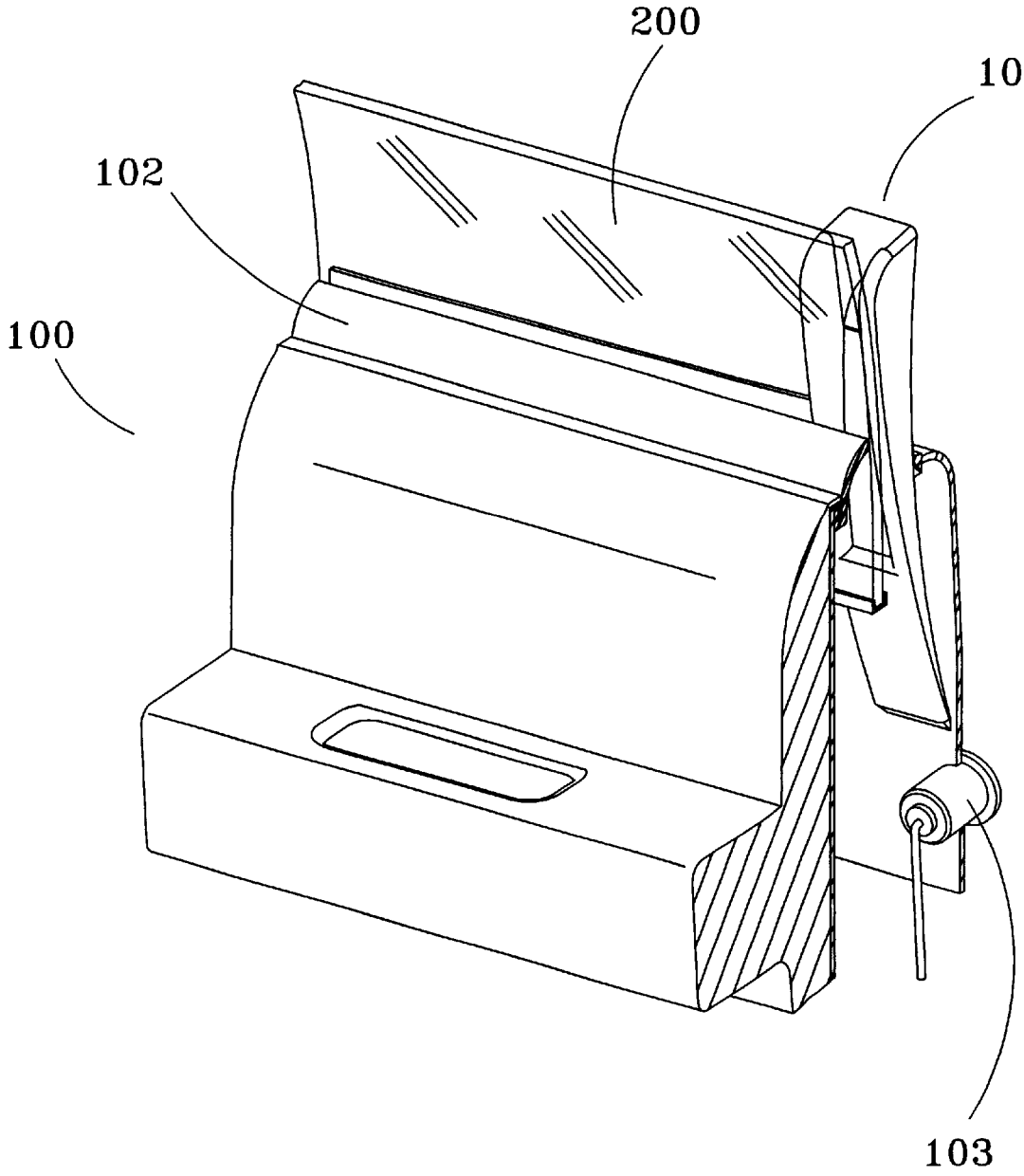
FIG. 6 is a isometric view of the wedge, car door and window of FIG. 5.

As seen in FIGS. 1, 5 and 6, a typical car, truck or other vehicle door 100 supports a rolling glass window 200. The lower edge of the window is typically encased in a window frame 210, which is best seen in the cross-sectional view of FIG. 1.

Figure 4:
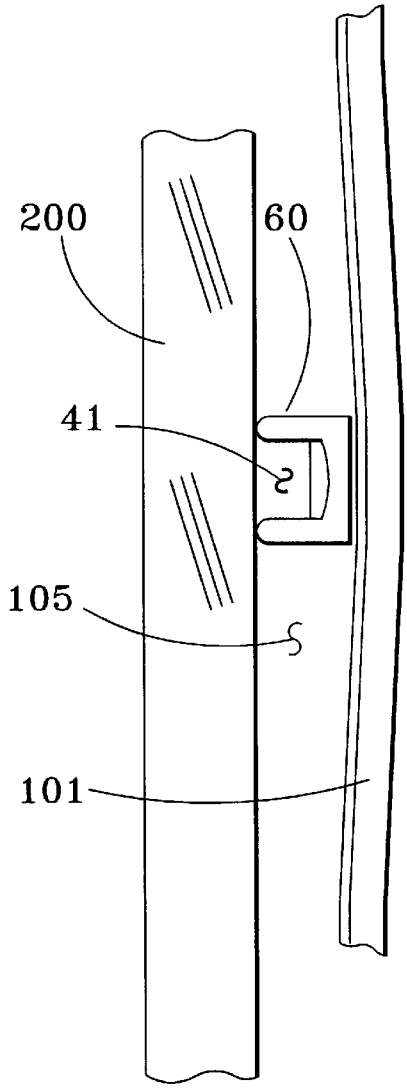
FIG. 4 is a top view of the wedge of FIG. 2, having been inserted between the outer wiper and window of a car's door.

The outside and inside surfaces of the window are sealed against outer and inner wipers 101, 102, respectively. Such wipers are typically made of a rubber-like material which provides a weather-tight seal against the glass. The material is resiliently deformable, in that where a wedge is inserted between the glass and outer wiper, as seen in FIG. 4, the wiper moves away from the glass. However, when the wedge is removed, the wiper assumes its original shape, configuration and location.

As seen in FIGS. 1 and 6, a lock mechanism 103 is located within the door cavity 104. The wedge 10 separates the outer wiper 101 from the window 200, providing a gap 105 wide enough for the locksmith to insert tools into the door cavity to reach this lock mechanism.

A tapered lower body 20 is sized to slide between the outer wiper 101 and outer surface of the vehicle's window 200, thereby separating the wiper from the window. Once separated, a locksmith's unlocking tool may be inserted into the door cavity 104 to release the lock 103.

A preferred tapered lower body is bounded by a slightly ramped surface 22 adjacent to a generally parabolic blade surface 23, and adjacent lower portions of the parabolic inner surface 80 and opposed tapered side surfaces 90.

A lower edge 21 is formed by the intersection of two surfaces, the ramped lower surface 22 and the lower portion of the parabolic inner surface 80. The angle between these surfaces results in a sufficiently sharp wedge- or chisel-type edge to easily separate the outer wiper 101 from the window surface 200.

The generally parabolic blade surface 23 is opposite (i.e. on opposed sides of the wedge from) the inner surface 80. The distance between these surfaces increases slightly as the distance from the lower edge 21 increases. That is, the lower portion of the tapered lower body 20, as oriented in FIG. 2, is narrower than the upper portion of the tapered lower body.

Figure 2:
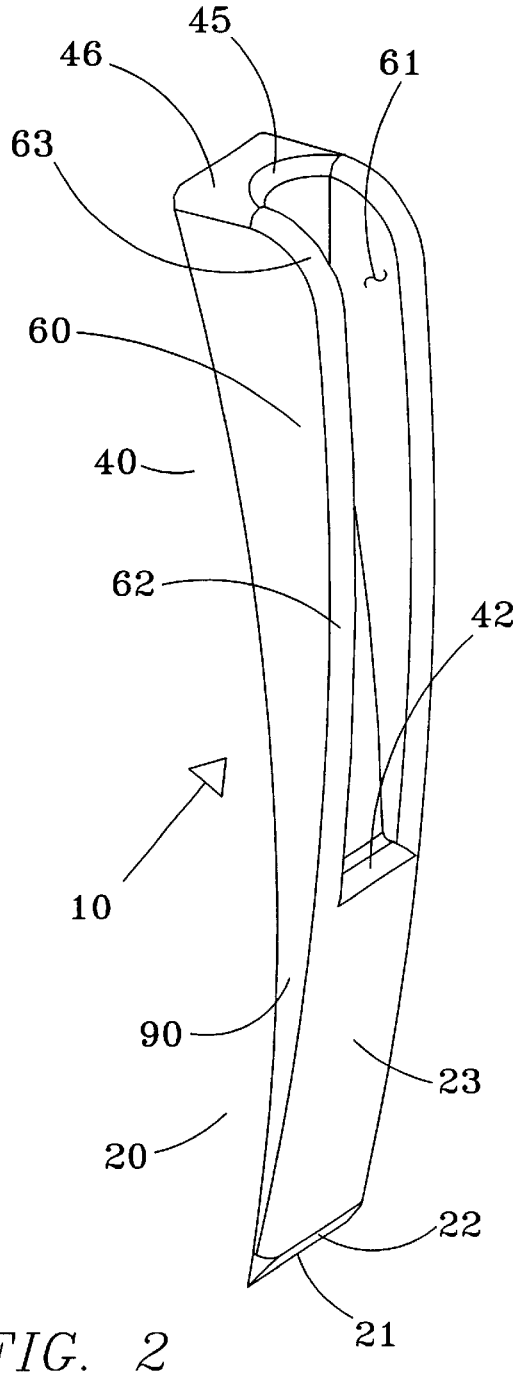
FIG. 2 is a isometric view of a preferred version of the locksmith's wedge for opening automobile doors, showing the channelized upper body and the tapered lower body.

As seen in FIG. 2, the upper portion of the wedge 10 is includes an channelized upper body 40, supporting two opposed sidewalls 60, defining a channel 41 between them.

The channelized upper body 40 is adjacent to a shoulder 42 defined on an upper portion of the generally parabolic blade surface 23. The upper body 40 includes a parabolic channel base surface 43 and a rounded upper channel base surface 44. A top portion 46 of the wedge is separated from the rounded base surface 44 by a rim 45.

As seen particularly in FIG. 2, first and second sides of the channelized upper body support first and second opposed sidewalls 60. Each sidewall has an upper surface or ledge 62, and a rounded corner 63 adjacent to the top 46 of the channelized upper body 40. The area bounded by the inner sidewall surface 61, the parabolic base surface 43 and the rounded base surface 44 defines a channel 61 through the upper body 40.

Figure 3:
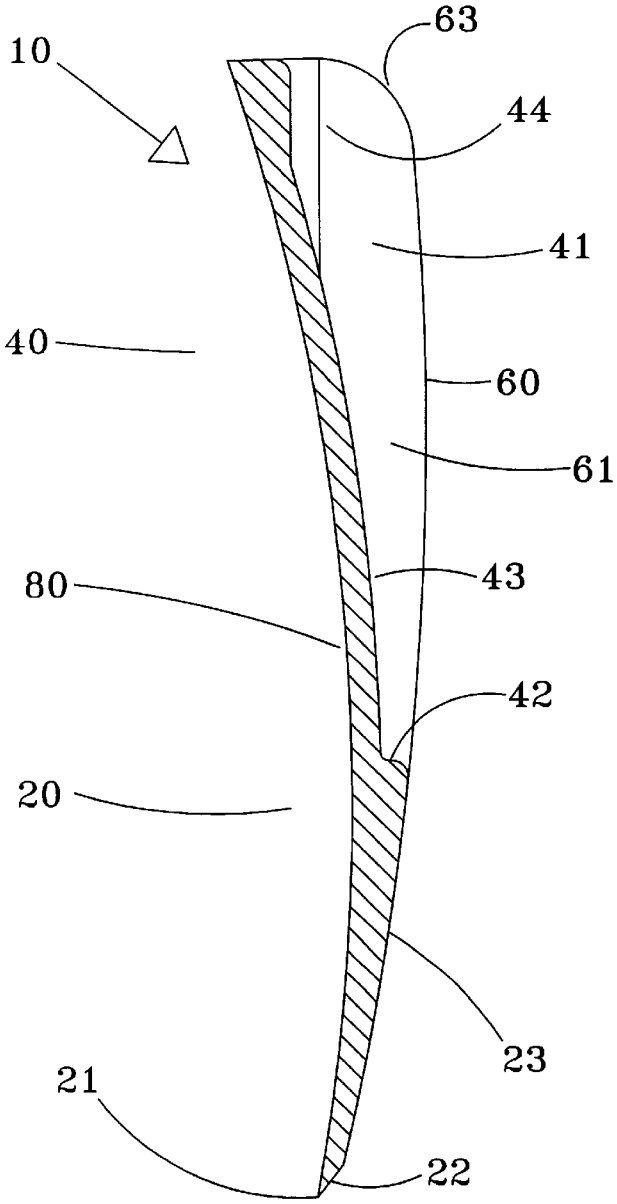
FIG. 3 is a cross-sectional view of the wedge of FIG. 2.

As seen particularly in FIGS. 3 and 5, a parabolic inner surface 80 extends the length of the wedge 10. The parabolic inner surface is between, or adjacent to, the first and second tapered side surfaces 90, and is on the side of the wedge opposite the opening to the channel 41.

First and second tapered side surfaces 90 extend the length of the locksmith's wedge 10. Each of the tapered sides 90 is adjacent to an opposite side of the parabolic inner surface 80. Each of the tapered sides tapers from a wide point adjacent to the top 46 of the channelized upper body 40 to a narrow point adjacent to the lower edge 21.

Referring to FIGS. 5 and 6, the use of the locksmith's wedge 10 may be understood. The tapered lower edge 21 is inserted between the outer surface of the window 200 and the outer wiper 101. The parabolic inner surface 80 is oriented so that it is in contact with the wiper 101, while the open channel 41 faces the window 200.

As seen in FIG. 5, due to the curve of the wedge, the tapered lower edge 21 easily passes the window frame 210 without becoming stuck. Due to the taper of the wedge, best seen in FIGS. 2, 3 and 5, the outer wiper 101 may be pushed away from the window, resulting in a gap 105.

A small flashlight may be positioned within the channel 41, between the base surface 43, sidewalls 60 and the window 200. With the light source pointed downwardly, the door cavity 104 is illuminated, allowing the locksmith to see the lock mechanism 103.

By inserting known tools through the gap 105, the locksmith is able to release the lock mechanism 103, thereby opening the door.

In an optional usage, two or more wedges 10 may be inserted between the window and the outer wiper 101. This results in an additional location within which a small flashlight may be supported, and also in more complete separation of the inner wiper and window.

The previously described versions of the present invention have many advantages, including a primary advantage of providing a novel locksmith's wedge for opening vehicle doors having a taper precisely calculated to slide between wiper and window and a curved shape which allows superior control over the position of the wedge and the distance by which the wiper is separated from the window.

Another advantage of the present invention is to provide a locksmith's wedge for opening vehicle doors that is easily and inexpensively manufactured, and that is adaptable for use in a wide variety of cars and trucks.

A still further advantage of the present invention is to provide a locksmith's wedge for opening vehicle doors that includes an upper body having a channel defined in the upper body within which the locksmith may support a small flashlight to illuminate the vehicle's door's interior cavity.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while a detailed description and drawings of a preferred version has been disclosed, some modification of the shape of the wedge could be resorted to, while still in keeping with the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A locksmith's wedge, for separating an outer wiper and an outer surface of a vehicle's window, comprising:

(A) a tapered lower body, sized to slide between the outer wiper and the outer surface of the vehicle's window, thereby separating the outer wiper from the vehicle's window, the tapered lower body;

(B) a channelized upper body, adjacent to a shoulder defined on an upper portion of a smooth, convex parabolic blade surface, the channelized upper body comprising first and second opposed sidewalls defining an open ended channel between the first and second opposed sidewalls and the channelized upper body;

(C) first and second tapered side surfaces extend lengthwise, adjacent to the convex parabolic blade surface; and (D) a concave parabolic inner surface extending lengthwise adjacent to the first and second tapered side surfaces.

2. A locksmith's wedge, for separating an outer wiper and an outer surface of a vehicle's window, comprising:

(A) a tapered lower body, sized to slide between the outer wiper and the outer surface of the vehicle's window, thereby separating the outer wiper from the vehicle's window, the tapered lower body comprising:

(a) a lower edge;

(b) a slightly ramped surface, adjacent to the lower edge; and (c) a smooth, convex parabolic blade surface, adjacent to the slightly ramped surface;

(B) a channelized upper body, adjacent to a shoulder defined on an upper portion of the convex parabolic blade surface, the channelized upper body comprising first and second opposed sidewalls, carried by opposed first and second sides of the channelized upper body, whereby an open ended channel is defined between the first and second opposed sidewalls and the channelized upper body;

(C) first and second tapered side surfaces extend lengthwise, adjacent to the convex parabolic blade surface, the first and second tapered side surfaces tapering from a widest extent adjacent to a top of the channelized upper body to a narrowest extent adjacent to the lower edge; and (D) a concave parabolic inner surface extending lengthwise adjacent to the first and second tapered side surfaces.

* * * * *